United States Patent [19]

Cole et al.

[11] 4,164,871

[45] Aug. 21, 1979

[54] PUSH DRILL GUIDANCE INDICATION APPARATUS

[75] Inventors: Charles F. Cole; Jimmie H. Elenburg, both of Ponca City, Okla.

[73] Assignee: Continental Oil Company, Ponca City, Okla.

[21] Appl. No.: 891,679

[22] Filed: Mar. 30, 1978

[51] Int. Cl.[2] ..... E21B 7/08

[52] U.S. Cl. ..... 73/432 R; 175/24

[58] Field of Search ..... 175/41, 45, 24, 73; 73/151, 432 R; 299/1

[56] References Cited

U.S. PATENT DOCUMENTS

| | | | |
|---|---|---|---|
| 3,766,787 | 10/1973 | Irvine | 73/517 A X |
| 3,823,787 | 7/1974 | Haworth et al. | 175/41 X |
| 3,888,319 | 6/1975 | Bourne, Jr. et al. | 175/24 X |

*Primary Examiner*—Jerry W. Myracle

*Attorney, Agent, or Firm*—William J. Miller

[57] ABSTRACT

An electronic guidance system for a push drill that is remotely guided by the operator. The system functions to maintain continual indication as to the attitude of the drilling apparatus, i.e., pitch, roll and distance to rock formations overlying or underlying the drilled stratum, with such indication being made available to the remote operator so that he can control the progression of the drilling apparatus. The drilling apparatus utilizes an instrument package adjacent the drilling mechanism which samples pitch and roll data through accelerometer output, and which monitors the distance of the drill head from adjacent rock formations by means of gamma ray count.

6 Claims, 4 Drawing Figures

PUSH DRILL GUIDANCE INDICATION APPARATUS

BACKGROUND OF THE INVENTION

1. Field of the Invention

The invention relates generally to drilling machine guidance systems and, more particularly, but not by way of limitation, it relates to an improved guidance system for use in horizontal drilling apparatus of the type used in mining operations.

2. Description of the Prior Art

There are numerous prior art guidance systems for use with drilling apparatus, both horizontal drilling machines and vertical or well drilling apparatus. U.S. Pat. No. 3,362,750 discloses a mining apparatus having programmed cutting direction and attitude controls, and this teaching utilizes a comparator for sensing a departure of the cutting machine from its programmed direction thereafter to correct the deviations. The system utilizes a plurality of pendulums and related comparator circuitry for sensing program deviations. U.S. Pat. No. 3,326,008 relates to an electrical gopher which is utilized to bore horizontal cable holes. This device utilizes a plurality of synchro motors to maintain its guidance direction. Still other forms of circuitry are utilized in the prior art, especially that art which is related to position keeping within vertical boreholes and well drilling apparatus; however, none of the prior art approaches are similar to the present circuit apparatus nor do they offer the attendant functions and advantages for operation of a push drill remotely guided through a mineral stratum.

SUMMARY OF THE INVENTION

The present invention contemplates a remote control system for a push drill of the type used for drilling relatively long distances through a mineral stratum. In a more limited aspect, the invention consists of an instrument package which is integrally connected into the push drill string for control communication back to an operator position. The system utilizes accelerometer sensing to determine pitch and roll of the drill instrument while gamma ray count is utilized to determine vertical positioning of the push drill relative to overlying and underlying rock formations, e.g., shale formations adjacent coal seams. Control signals are then processed in the instrument package for transmission back along a control cable to the operator position, whereupon output indication enables the operator to hydraulically control the push drill to accomplish attitude correction during progression through the mineral stratum.

Therefore, it is an object of the present invention to provide remote control apparatus for guiding a mining push drill from an operating position that may be a great distance therefrom.

It is also an object of the present invention to provide an electronic guidance system for a push drill that is remotely guided by an operator using electrical signal indications returned to the mineral stratum face by a long electrical cable extending from the hydraulically controlled push drill.

It is yet another object of the invention to provide a system for guidance of a push drill through a coal seam utilizing the natural radioactivity of the surrounding shale deposits or strata.

Finally, it is an object of the invention to provide an improved remote control instrument package for integral inclusion into the push drill string of operative elements.

Other objects and advantages of the invention will be evident from the following detailed description when read in conjunction with the accompanying drawings which illustrate the invention.

DETAILED DESCRIPTION OF THE PREFERRED EMBODIMENT

Figure 1:
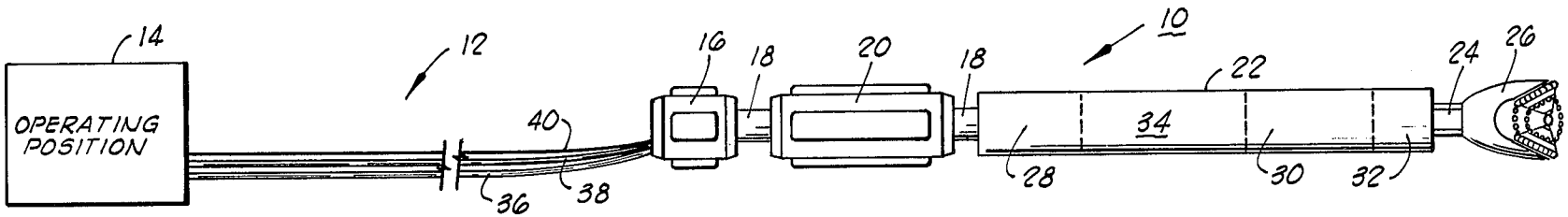
FIG. 1 is a plan view in side elevation of the push drill assembly as it extends from an operating position.

FIG. 1 illustrates a push drill assembly 10, as constructed in accordance with the present invention to include control instruments, as interconnected via control line 12 to an operating position 14. The push drill unit 10 includes a retraction hold unit 16, as rigidly connected via drill stem 18 to a hold unit 20 which, again, is connected by drill stem 18 into a drill assembly 22 having a forward output shaft 24 and drill head 26. The push drill assembly 10 is the particular subject matter of U.S. Pat. No. 3,888,319 in the name of Bourne et al. as issued on June 10, 1975, and particulars of that structure are fully brought out in that disclosure.

The push drill assembly 10 is a self-propelling drill unit capable of directional drilling control under proper instrumentation. The drill unit 22 includes a roll control unit 28, drill motor 30 and deflection unit 32, and the control instrumentation package may be carried as indicated by instruments 34. The push drill assembly 10 is connected back to the operating position 14 by means of hydraulic hoses 36 and 38, and an electrical cable 40. Hydraulic hose 36 provides drive pressure to drill motor 30 while hydraulic hose 38, actually three hoses in number, provide control actuation to the hold and deflection units.

Figure 2:
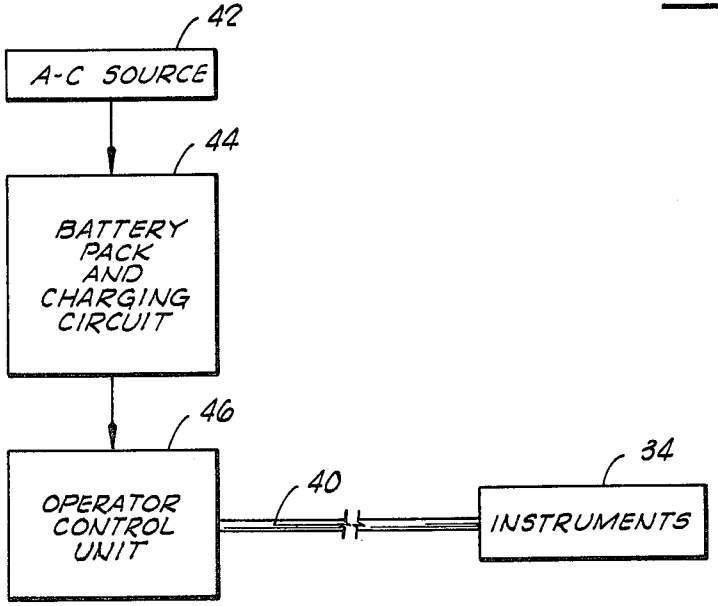
FIG. 2 is a block diagram illustrating the operative association of elements.

As shown in FIG. 2, the operating position 14 includes a battery pack and charging circuit 44 connected through an operator control unit 46 and remote cable 40 to instruments 34. The battery pack and charging circuit 44 is a conventional form of circuit as energized by A-C source 42 to utilize full wave rectifiers and respective EVEREADY rechargeable alkaline cells, Type No. 565, to provide continual power supply output. A power output of positive 18 volts, common and negative 18 volts is supplied via three conductors to the operator control unit 46. The A-C power source 42, is used to charge the battery pack at the surface of a mine, but it is not used during guidance operations.

Figure 3:
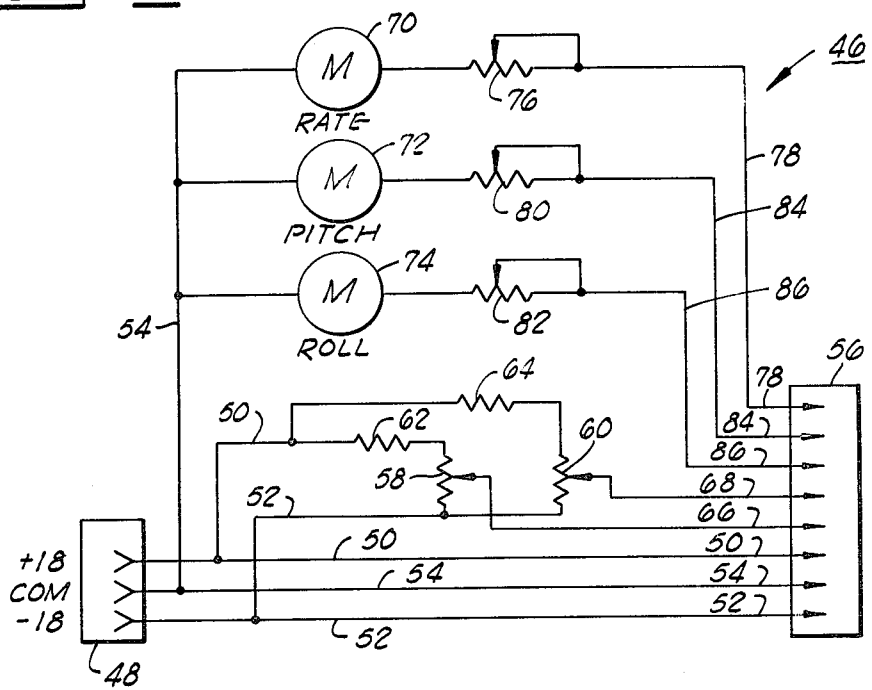
FIG. 3 is a schematic diagram of the operator control unit and interconnections.

Referring to FIG. 3, the operator control unit 46 receives power supplied at a connector 48 via leads 50, 52 and common lead 54, the power leads also being connected directly through an eight pin connector 56 for connection to push drill supply cable 40, as will be described. The negative 18 volt lead 52 is connected to ZERO ADJUST potentiometers 58 and 60, pitch and roll respectively, which return via respective resistors 62 and 64 to the positive 18 volt lead 50. The center tap of PITCH potentiometer 58 is connected via a conductor 66 through connector 56 and cable 40, and the center tap of ROLL potentiometer 60 is connected via conductor 68 to connector 56. Operator indication of RATE, PITCH and ROLL appears on meters 70, 72 and 74, respectively. Meter 70, 15ma D-C, connects through a gain potentiometer 76 and lead 78 to connector 56; in like manner, meters 72 and 74 (each 10ma-0-10ma) connect through gain potentiometers 80 and 82 and respective leads 84 and 86 for connection at connector 56.

Figure 4:
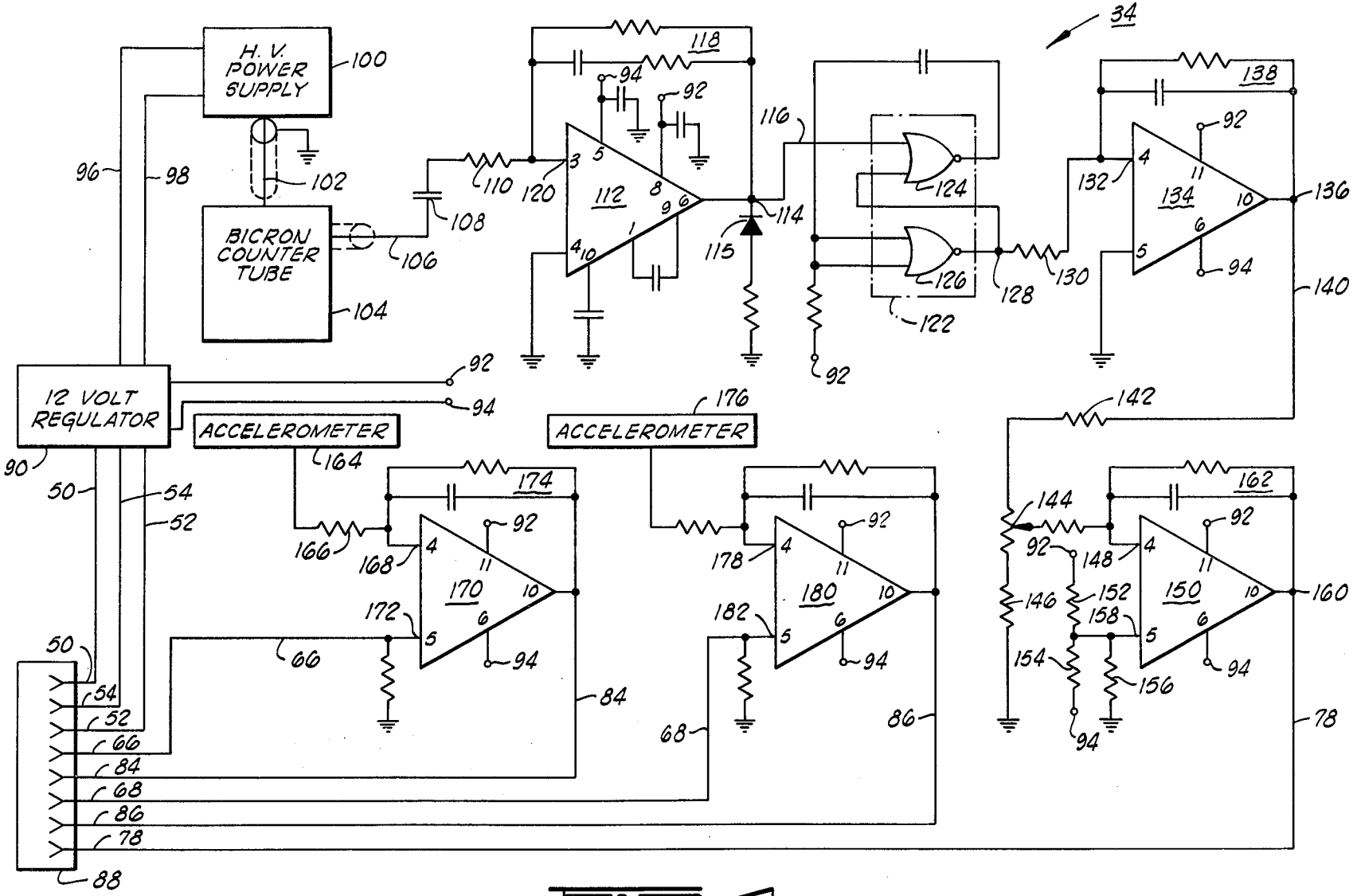
FIG. 4 is a schematic diagram of the instrument package of the present invention.

Output from connector 56 is then by drill control cable 40 to the instrument unit 34 within drill unit 22, as shown in FIG. 4. The control cable 40 may be on the order of 1000 to 2000 feet in length. Connector input from drill control cable 40 is applied at receptacle 88, as like conductors bear the same designators as were input at connector 56 (Fig. 3). The power leads 50, 52 and 54 are applied directly to a 12 volt regulator 90, a standard form of regulator circuit, which provides regulated voltage output, i.e., positive 12 volts at a terminal 92 and negative 12 volts at terminal 94. Common connection of 12 volt regulator 90 is indicated as ground in the circuit of FIG. 4.

Positive 12 volt output and common connection from 12 volt regulator 90 are also provided on respective leads 96 and 98 to a high voltage power supply 100 for energization, i.e., 1200 volts, via shielded lead 102 to a BICRON counter tube 104, a scintillation detector. The high voltage power supply 100 is a 100:1 step-up DC-DC transformer type, Model K-15, as is commercially available from Venus Scientific of Farmingdale, N.Y. The BICRON counter tube 104 is a commercially available gamma ray counter tube, Model 2M2P that is available from the Bicron Corporation of Newbury, Ohio. Gamma count output in the 2 volt range is then present on a lead 106 through a coupling capacitor 108 and resistor 110 to one input of an integrated circuit pre-amplifier 112, IC Type 715393. Output from amplifier 112 is taken at junction 114 via lead 116, and control feedback from junction 114 through resistor-capacitor network 118 is applied to the input 120. A diode 115 provides for removal of any negative voltage spikes.

The gamma count output on lead 116 is then applied to a threshold limiting circuit 122, an integrated circuit dual NOR gate, Type CD 4001. Input on lead 116 to NOR gate 124 is latched to condition by NOR gate 126 with output present at junction 128 only when exceeding the bias present at junction 129. The output signal is then applied through resistor 130 to an input 132 of an integrator 134, an integrated circuit operational amplifier, Type MC 1741. Integration of output at junction 136 is effected by feedback through a capacitor-resistor timing network 138 to input 132. The integrated output signal is applied on lead 140 to a resistor network consisting of resistor 142 in series with a calibration potentiometer 144 and a common connected resistor 146.

Potentiometer 144 provides a gamma count calibration adjustment as signal is applied to an input 148 of a VA converter 150, a D-C amplifier, as biased by a voltage divider consisting of resistors 152, 154 and 156 to provide reference input at input 158. The converter 150 is once again the integrated circuit Type MC 1741 with output provided at a junction 160 and feedback through resistor-capacitance network 162 to the input 148. Output in the form of current indication from junction 160 is then present on lead 78 for return to receptacle 88 and control cable 40 to gain potentiometer 76 and RATE meter 70 of the operator control unit 46 (See FIG. 3).

Thus, meter 70 will read the instantaneous rate of gamma count as sensed by BICRON counter tube 104.

The BICRON counter tube 104 is preferably mounted and shielded to view upward or downward from the instrument unit 34, depending upon initial installation and the particular type of drilling surveillance. It is now established that gamma radiation produced by the radioactive decay or uranium, thorium, potassium-40, as is naturally present in shale rock, is attenuated by coal in a logarithmic manner with a half-thickness value of approximately 7 inches. Also, shale formations are nearly always present above and below coal seams or strata and these strata will contain the necessary radioactive elements. Thus, sensing of this natural radioactivity provides a means for enabling a meter indication that will allow the drill operator to hydraulically change the push drill's position relative to adjacent strata for guidance through the mineral stratum.

The pitch of the push drill assembly 10 is sensed by an accelerometer 164 with output signal provided through a dropping resistor 166 to input 168 of a VA converter amplifier 170 (DC amplifier), Type MC 1741. Reference input is applied via lead 66 from ZERO ADJUST potentiometer 58 in the operator control unit 46 (FIG. 3) as applied to amplifier input 172. Control feedback is applied from the output via resistor-capacitor network 174 to the input 168, and amplifier output is applied on lead 84 through receptacle 88 and the control cable 40 for representation on pitch meter 72 at control unit 46. The accelerometer 164 is a static displacement form known as the Columbia Type SA 107 as made available by Columbia Research Laboratories. The accelerometer 164 provides a steady D-C output proportional to angle such that an adjusted meter 72 range of 0–5 volts will be indicative of pitch change from 0° to 90°. Accelerometer 164 may be suitably mounted in instrument unit 34 to sense the longitudinal angular deviation.

The roll sensing is carried in like manner as a similar type of accelerometer 176 provides input to identical circuitry at amplifier input 178 of a D-C amplifier 180 (also Type MC 1741). A reference input 182 is connected to lead 68, control cable 40 and control unit ZERO ADJUST potentiometer 60 (FIG. 3), and output on lead 86 is similarly conducted back through control cable 40 and gain control 82 for indication at the Roll meter 74 at the control unit. (Roll accelerometer 176 is mounted to sense transverse angular deviation).

In operation, after proper ZERO ADJUST of the pitch and roll meters and rate meter 70 relative to the push drill assembly 10 with zero attitude and indication, the guidance system is ready to function. The operation will also have access to the hydraulic control mechanism at the operating position 14 so that, as he observes the operator control unit 46, he is able to actuate hydraulic controls for any of drill motor 30, deflection unit 32, roll control unit 28 or the hold assemblies to properly direct the drill head 26 through the mineral stratum. As previously stated, the BICRON counter tube 104 (FIG. 4) is preferably shielded for isolation to a selected directivity, e.g., perpendicular to the overlying shale stratum, so that variations in reading of the rate meter 70 at operating position 14 enable the operator to maintain a long hole course within the drilling stratum of interest.

The foregoing discloses a new and useful guidance system for controlling the position and attitude of a push drill through a mineral stratum. The device employs a unique combination of accelerometer sensing to determine pitch and roll of the drill instrument while also sensing the natural gamma ray radiation emanating from shale stratum above, below, banded within or adjacent to the particular mineral stratum. The guidance system has the unique capability of offering very accurate control indication while being packaged in a highly reliable yet relatively small package, an instrumentation package that is quite easily installed within the structure of the push drill assembly. It is also contemplated and a result of the logical course that indications of pitch, roll and gamma incidence or rate, as received at the remote operating position, will also be conditioned for input to computer apparatus whereupon detailed stratum analysis can be carried out with subsequent printout of three-dimensional or other mapping information. Further, it is contemplated that two uni-directional BICRON counter tubes may be utilized in 180° displacement to enable a Rate reading in each of opposite directions from the push drill assembly thereby to enable still further data compilation.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A remote guidance indication system for push drills of the type that are continuously controllable as to pitch and roll of the longitudinal axis in order to determine directivity, comprising:

first sensing means in said push drill generating a first output signal indicative of the push drill pitch;

second sensing means in said push drill generating a second output signal indicative of the push drill roll;

radiation sensing means responsive to natural radioactivity emanating from space adjacent said push drill and generating a rate signal proportional to radiation count rate, said radiation sensing means including a gamma ray counter means providing count pulse output and means for amplifying and integrating said pulse output to provide a signal having an amplitude indicative of gamma ray count per unit time; and remote operating means connected to receive said first and second output signals and said rate signal to provide indication enabling remote guidance control of said push drill.

2. A remote guidance indication system as set forth in claim 1 wherein said means for amplifying and integrating comprises:

amplifier means receiving said count pulse output and providing a unipolar output pulse signal;

limiting means receiving said pulse signal and providing output of pulse signals greater than a predetermined threshold amplitude;

means for integrating said limited pulse signals; and means converting said integrated signal to D-C current output for transmission to said remote operating means.

3. A system as set forth in claim 1 wherein said first sensing means comprises:

accelerometer means mounted to sense angular deviation of the longitudinal axis of said push drill and providing an output voltage indicative thereof; and converter means receiving said output voltage and generating a D-C current output for transmission to said remote operating means.

4. A system as set forth in claim 3 wherein said second sensing means comprises:

accelerometer means mounted to sense angular deviation of the transverse axis of said push drill and providing an output voltage indicative thereof; and converter means receiving said output voltage and generating a D-C current output for transmission to said remote operating means.

5. A system as set forth in claim 4 wherein said radiation sensing means comprises:

gamma ray counter means providing count pulse output; and means for amplifying and integrating said pulse output and providing a D-C signal having amplitude indicative of gamma ray count per unit time.

6. A system as set forth in claim 1 wherein said second sensing means comprises:

accelerometer means mounted to sense angular deviation of the transverse axis of said push drill and providing an output voltage indicative thereof; and converter means receiving said output voltage and generating a D-C current output for transmission to said remote operating means.

* * * * *